US011236669B2

(12) United States Patent
Gupta et al.

(10) Patent No.: US 11,236,669 B2
(45) Date of Patent: Feb. 1, 2022

(54) TURBINE AND TURBOCHARGER

(71) Applicant: MITSUBISHI HEAVY INDUSTRIES ENGINE & TURBOCHARGER, LTD., Sagamihara (JP)

(72) Inventors: Bipin Gupta, Tokyo (JP); Toyotaka Yoshida, Tokyo (JP)

(73) Assignee: MITSUBISHI HEAVY INDUSTRIES ENGINE & TURBOCHARGER, LTD., Kanagawa (JP)

( * ) Notice: Subject to any disclaimer, the term of this patent is extended or adjusted under 35 U.S.C. 154(b) by 0 days.

(21) Appl. No.: 16/770,830

(22) PCT Filed: Dec. 20, 2017

(86) PCT No.: PCT/JP2017/045701
§ 371 (c)(1),
(2) Date: Jun. 8, 2020

(87) PCT Pub. No.: WO2019/123565
PCT Pub. Date: Jun. 27, 2019

(65) Prior Publication Data

US 2021/0164384 A1 Jun. 3, 2021

(51) Int. Cl.
*F02B 37/24* (2006.01)
*F01D 17/16* (2006.01)
*F01D 9/02* (2006.01)

(52) U.S. Cl.
CPC ..... *F02B 37/24* (2013.01); *F01D 17/165* (2013.01); *F01D 9/026* (2013.01);
(Continued)

(58) Field of Classification Search
CPC ..... F02B 37/24; F01D 17/165; F01D 9/026; F05D 2260/60; F05D 2220/40; F05D 2240/128
(Continued)

(56) References Cited

U.S. PATENT DOCUMENTS 9,388,707 B2 7/2016 Martinez-Botas et al.
2010/0247296 A1 9/2010 Matsuyama
(Continued)

FOREIGN PATENT DOCUMENTS

CN 101896704 A 11/2010
CN 102325974 A 1/2012
(Continued)

OTHER PUBLICATIONS

International Preliminary Report on Patentability and Written Opinion of the International Searching Authority with an English translation, dated Jul. 2, 2020, for International Application No. PCT/JP2017/045701.
(Continued)

*Primary Examiner* — J. Todd Newton
(74) *Attorney, Agent, or Firm* — Birch, Stewart, Kolasch & Birch, LLP

(57) ABSTRACT

A turbine includes: a turbine impeller; a housing disposed so as to enclose the turbine impeller, and including a scroll passage positioned on an outer circumferential side of the turbine impeller and an inner circumferential wall part defining an inner circumferential boundary of the scroll passage; a plurality of nozzle vanes disposed inside an intermediate flow passage which is positioned, in an exhaust gas flow direction, on a downstream side of the scroll passage and on an upstream side of the turbine impeller; and a plate disposed on a side of the intermediate flow passage with respect to the inner circumferential wall part so as to face the intermediate flow passage such that a gap is formed between the plate and the inner circumferential wall part in an axial direction. The plate has at least one through hole through which the intermediate flow passage and the gap are communicated with each other. The at least one through hole opens to a surface of the plate facing the intermediate flow
(Continued)

passage, at a position on a radially outer side with respect to a suction surface of at least one of the plurality of nozzle vanes.

7 Claims, 5 Drawing Sheets

(52) U.S. Cl.
CPC .... *F05D 2220/40* (2013.01); *F05D 2240/128* (2013.01); *F05D 2260/60* (2013.01)

(58) Field of Classification Search
USPC ..... 415/418
See application file for complete search history.

(56) References Cited

U.S. PATENT DOCUMENTS

| | | | | |
|---|---|---|---|---|
| 2011/0206500 | A1 | 8/2011 | Nagao et al. | |
| 2011/0296829 | A1 | 12/2011 | Hayashi et al. | |
| 2013/0272847 | A1 | 10/2013 | Martens et al. | |
| 2014/0178181 | A1 | 6/2014 | Tashiro et al. | |
| 2016/0326951 | A1* | 11/2016 | Groves ..... | F02B 37/24 |
| 2018/0030848 | A1 | 2/2018 | Kobayashi et al. | |
| 2018/0230851 | A1 | 8/2018 | Katou et al. | |

FOREIGN PATENT DOCUMENTS

| | | | |
|---|---|---|---|
| DE | 10 2011 120 880 | A1 | 6/2013 |
| EP | 2 150 684 | A2 | 2/2010 |
| JP | 2009-8013 | A | 1/2009 |
| JP | 2013-72404 | A | 4/2013 |
| JP | 2013-245655 | A | 12/2013 |
| WO | 2008129274 | A2 | 10/2008 |
| WO | WO 2008/129274 | A2 | 10/2008 |
| WO | WO 2010/052911 | A1 | 5/2010 |
| WO | WO 2016/079872 | A1 | 5/2016 |
| WO | WO 2016/159004 | A1 | 10/2016 |

OTHER PUBLICATIONS

International Search Report, dated Feb. 20, 2018, for International Application No. PCT/JP2017/045701.

European Office Action dated Jun. 10, 2021 for Application No. 17 935 539.1.

Japanese Office Action dated Jun. 15, 2021 for Application No. 2019-559926 with an English translafion.

Extended European Search Report dated Sep. 14, 2020 issued to the corresponding European Application No. 17935539.1.

Office Action dated Sep. 27, 2021 issued in counterpart Chinese Application No. 201780097784.6.

* cited by examiner

TURBINE AND TURBOCHARGER

TECHNICAL FIELD

The present disclosure relates to a turbine and a turbocharger.

BACKGROUND

A turbocharger including nozzle vanes for adjusting flow of exhaust gas flowing into turbine rotor blades has been used.

For example, Patent Document 1 discloses a turbocharger including guide vanes (nozzle vanes) arranged in a flow space (intermediate flow passage) through which exhaust gas flows from a flow space (scroll passage) positioned on the outer circumferential side of a turbine impeller into the turbine impeller. The intermediate flow passage is formed between a blade bearing ring supporting the guide vanes and a cover disc located opposite the blade bearing ring. The guide vanes are rotatably mounted to the blade bearing ring via a blade bearing pin penetrating the blade bearing ring. Further, the cover disc forming the intermediate flow passage together with the blade bearing ring has through holes extending in the same direction as the blade bearing pin on the extension of the blade bearing pin. Thus, a force due to pressure differential across the cover disc (pressure differential between the scroll passage and the intermediate flow passage) is applied to the blade bearing pin via the guide vanes and counteracts a force acting on the blade bearing pin, reducing wear of components such as guide vanes.

CITATION LIST

Patent Literature

Patent Document 1: US Patent Application Publication No. 2013/0272847

SUMMARY

Problems to be Solved

As a result of intensive studies by the present inventors, it has been found that, during operation of a turbocharger including nozzle vanes, pressure distribution occurs in a housing, particularly, with a relatively high pressure in a gap between a housing wall surface forming a scroll passage and a plate forming an intermediate flow passage in which the nozzle vanes are arranged, and a low pressure in the vicinity of the suction surfaces of the nozzle vanes. The pressure differential between the gap and the vicinities of the suction surfaces of the nozzle vanes may cause pressure loss in the turbine. It is thus desired to reduce the pressure differential.

In view of the above, an object of at least one embodiment of the present invention is to provide a turbine and a turbocharger whereby it is possible to reduce pressure loss due to pressure distribution inside the housing.

Solution to the Problems (1) A turbine according to at least one embodiment of the present invention comprises: a turbine impeller; a housing disposed so as to enclose the turbine impeller and including a scroll passage positioned on an outer circumferential side of the turbine impeller and an inner circumferential wall part defining an inner circumferential boundary of the scroll passage; a plurality of nozzle vanes disposed inside an intermediate flow passage which is positioned, in an exhaust gas flow direction, on a downstream side of the scroll passage and on an upstream side of the turbine impeller; and a plate disposed on a side of the intermediate flow passage with respect to the inner circumferential wall part so as to face the intermediate flow passage such that a gap is formed between the plate and the inner circumferential wall part in an axial direction. The plate has at least one through hole through which the intermediate flow passage and the gap are communicated with each other, and the at least one through hole opens to a surface of the plate facing the intermediate flow passage, at a position on a radially outer side with respect to a suction surface of at least one of the plurality of nozzle vanes.

During operation of the turbine, the gap between the inner circumferential wall part of the housing and the plate forming the intermediate flow passage may have relatively high pressure, while a relatively low pressure region may be formed in the vicinity of the suction surface of the nozzle vane disposed in the intermediate flow passage. In this case, due to the pressure differential between the gap and the vicinity of the suction surface of the nozzle vane, a flow with turbulence from the gap via the outer circumferential edge of the plate to the suction surface of the nozzle vane may be generated. Such flow with turbulence may cause pressure loss.

In this regard, with the above configuration (1), since the plate has the through hole through which the intermediate flow passage and the gap are communicated with each other and which opens on a side of the intermediate flow passage at a position on the radially outer side with respect to the suction surface of the nozzle vane, the pressures in the gap and in the vicinity of the suction surface of the nozzle vane inside the intermediate flow passage are equalized through the through hole. Thus, since the flow with turbulence from the gap via the outer circumferential edge of the plate to the suction surface of the nozzle vane due to the pressure differential between the gap and the vicinity of the suction surface of the nozzle vane is suppressed, it is possible to reduce pressure loss in the turbine.

Further, when there is the pressure differential between the gap and the vicinity of the suction surface of the nozzle vane, due to this pressure differential, the nozzle vane may tilt with respect to the plate, which may cause friction between the nozzle vane and the plate. In this regard, with the above configuration (1), since the pressures in the intermediate flow passage and the gap are equalized through the through hole, it is possible to prevent the nozzle vane from tilting due to the pressure differential, and it is possible to suppress friction between the nozzle vane and the plate.

(2) In some embodiments, in the above configuration (1), the plurality of nozzle vanes is arranged in a circumferential direction inside the intermediate flow passage so as to be rotatable around a rotation axis extending along the axial direction, and the at least one through hole opens to the surface at a position on a radially outer side with respect to the suction surface when an opening degree of each of the plurality of nozzle vanes is within at least a part of a large opening degree region in which A is not less than $0.5 \times A_1$, where A is an angle between chord directions of a pair of nozzle vanes which are adjacent to each other in the circumferential direction, among the plurality of nozzle vanes, and $A_1$ is the angle when the opening degree of the plurality of nozzle vanes is maximum.

According to findings of the present inventors, the pressure differential between the gap and the vicinity of the suction surface of the nozzle vane which may occur during operation of the turbine increases as the opening degree of the nozzle vane relatively increases, which leads to significant pressure loss due to the pressure differential.

In this regard, with the above configuration (2), since the through hole opens to the surface of the plate facing the intermediate flow passage, at a position on the radially outer side with respect to the suction surface of the nozzle vane when the opening degree of each nozzle vane is within at least a part of a large opening degree region in which A is not less than $0.5\times A_1$, it is possible to, in the large opening degree region of the nozzle vane, reliably equalize the pressures in the gap and in the vicinity of the suction surface of the nozzle vane inside the intermediate flow passage through the through hole. Thus, the flow with turbulence from the gap via the outer circumferential edge of the plate to the suction surface of the nozzle vane due to the pressure differential is suppressed, so that it is possible to more effectively reduce pressure loss in the turbine.

(3) In some embodiments, in the above configuration (1) or (2), the plurality of nozzle vanes is disposed so as to be rotatable around a rotation axis extending along the axial direction, and the at least one through hole opens to the surface of the plate at a position, in a circumferential direction, on an upstream side in the exhaust gas flow direction with respect to the rotation axis of the at least one nozzle vane.

With the above configuration (3), since the through hole opens to the surface of the plate facing the intermediate flow passage, at a position, in the circumferential direction, on the upstream side in the exhaust gas flow direction with respect to the rotation axis of the nozzle vane, the opening of the through hole on the surface easily comes close to the suction surface as the opening degree of the nozzle vane increases. Thus, the flow with turbulence from the gap via the outer circumferential edge of the plate to the suction surface of the nozzle vane due to the pressure differential is suppressed, so that it is possible to more effectively reduce pressure loss in the turbine.

(4) In some embodiments, in any one of the above configurations (1) to (3), the plurality of nozzle vanes is arranged in a circumferential direction inside the intermediate flow passage so as to be rotatable around a rotation axis extending along the axial direction, and when an opening degree of each of the plurality of nozzle vanes is such that A is $0.75\times A_1$, a distance L in a radial direction between the at least one through hole and the suction surface of the at least one nozzle vane is not greater than a diameter D of the at least one through hole, where A is an angle between chord directions of a pair of nozzle vanes which are adjacent to each other in the circumferential direction, among the plurality of nozzle vanes, and $A_1$ is the angle when the opening degree of the plurality of nozzle vanes is maximum.

With the above configuration (4), since when the opening degree of the nozzle vane is such that A is $0.75\times A_1$, the distance L in the radial direction between the through hole and the suction surface of the nozzle vane is not greater than the diameter D of the through hole, the through hole and the suction surface of the nozzle vane are relatively close to each other within a large opening degree region (e.g., opening degree region in which A is not less than $0.5\times A_1$) of the nozzle vane. Thus, in the large opening degree region of the nozzle vane, a region of the intermediate flow passage in the vicinity of the suction surface of the nozzle vane communicates with the gap through the through hole, so that the pressures in the gap and in the vicinity of the suction surface of the nozzle vane inside the intermediate flow passage are smoothly equalized through the through hole. Thus, the flow with turbulence from the gap via the outer circumferential edge of the plate to the suction surface of the nozzle vane due to the pressure differential between the gap and the vicinity of the suction surface of the nozzle vane is more effectively suppressed.

(5) In some embodiments, in any one of the above configurations (1) to (4), the plurality of nozzle vanes is arranged in a circumferential direction inside the intermediate flow passage so as to be rotatable around a rotation axis extending along the axial direction, and when an opening degree of each of the plurality of nozzle vanes is maximum, at least a part of the at least one through hole is positioned on a radially outer side with respect to the at least one nozzle vane, at the surface of the plate.

With the above configuration (5), when the opening degree of the nozzle vane is maximum (i.e., when the angle A is $A_1$), at least a part of the through hole is positioned on the radially outer side with respect to the nozzle vane, at the surface of the plate facing the intermediate flow passage. In other words, even when the opening degree of the nozzle vane is maximum and the suction surface of the nozzle vane is closest to the through hole, the opening of the through hole on the surface of the plate is not closed by the nozzle vane.

Thus, even when the opening degree of the nozzle vane is maximum, a region of the intermediate flow passage in the vicinity of the suction surface of the nozzle vane reliably communicates with the gap through the through hole. Thus, the pressures in the gap and the vicinity of the suction surface of the nozzle vane inside the intermediate flow passage are equalized through the through hole, and the flow with turbulence from the gap via the outer circumferential edge of the plate to the suction surface of the nozzle vane due to the pressure differential between the gap and the vicinity of the suction surface of the nozzle vane is more effectively suppressed.

(6) In some embodiments, in any one of the above configurations (1) to (5), in a cross-section perpendicular to the axial direction, when a rotational axis of the turbine is taken as a center, an angle at a position of a tongue of the scroll passage is defined as 0 degree, and the exhaust gas flow direction in a circumferential direction is taken as a positive angular direction, the at least one through hole is positioned within a range of at least 220 degrees and at most 360 degrees.

According to findings of the present inventors, in the vicinity of the outlet of the scroll passage, the pressure differential between the gap and the vicinity of the suction surface of the nozzle vane tends to particularly increase, so that the flow with turbulence which may cause pressure loss in the turbine is likely to occur.

In this regard, with the above configuration (6), since at least one through hole is provided within the range in which the above-described angle in the circumferential direction is at least 220 degrees and at most 360 degrees (i.e., in the vicinity of the outlet of the scroll passage), in this circumferential region, the pressures in the gap and the vicinity of the suction surface of the nozzle vane inside the intermediate flow passage are equalized through the through hole. Thus, the flow with turbulence from the gap via the outer circumferential edge of the plate to the suction surface of the nozzle vane due to the pressure differential between the gap and the vicinity of the suction surface of the nozzle vane is effectively suppressed, so that it is possible to effectively reduce pressure loss in the turbine.

(7) In some embodiments, in any one of the above configurations (1) to (6), in a cross-section including the axial direction, the at least one through hole extends along an extending direction of the suction surface of the at least one nozzle vane.

With the above configuration (7), since the through hole extends in the extending direction of the suction surface of the nozzle vane, it is possible to reduce turbulence of flow from the through hole to the intermediate flow passage. Consequently, it is possible to more effectively reduce pressure loss in the turbine.

(8) In some embodiments, in the above configuration (7), in a cross-section including the axial direction, the suction surface extends obliquely with respect to the axial direction, and the at least one through hole extends along an oblique direction of the suction surface with respect to the axial direction.

With the above configuration (8), when the suction surface of the nozzle vane is oblique with respect to the axial direction, the through hole obliquely extends along the oblique direction of the suction surface. Thus, the effect described in the above (7) can be achieved.

(9) A turbocharger according to at least one embodiment of the present invention comprises a turbine described in any one of the above (1) to (8) and a compressor configured to be driven by the turbine.

With the above configuration (9), since the plate has the through hole through which the intermediate flow passage and the gap are communicated with each other and which opens on a side of the intermediate flow passage at a position on the radially outer side with respect to the suction surface of the nozzle vane, the pressures in the gap and in the vicinity of the suction surface of the nozzle vane inside the intermediate flow passage are equalized through the through hole. Thus, since the flow with turbulence from the gap via the outer circumferential edge of the plate to the suction surface of the nozzle vane due to the pressure differential between the gap and the vicinity of the suction surface of the nozzle vane is suppressed, it is possible to reduce pressure loss in the turbine.

Further, when there is the pressure differential between the gap and the vicinity of the suction surface of the nozzle vane, due to this pressure differential, the nozzle vane may tilt with respect to the plate, which may cause friction between the nozzle vane and the plate. In this regard, with the above configuration (9), since the pressures in the intermediate flow passage and the gap are equalized through the through hole, it is possible to prevent the nozzle vane from tilting due to the pressure differential, and it is possible to suppress friction between the nozzle vane and the plate.

Advantageous Effects

At least one embodiment of the present invention provides a turbine and a turbocharger whereby it is possible to reduce pressure loss due to pressure distribution inside the housing.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

First, an overall configuration of a turbocharger according to some embodiments will be described.

Figure 1:
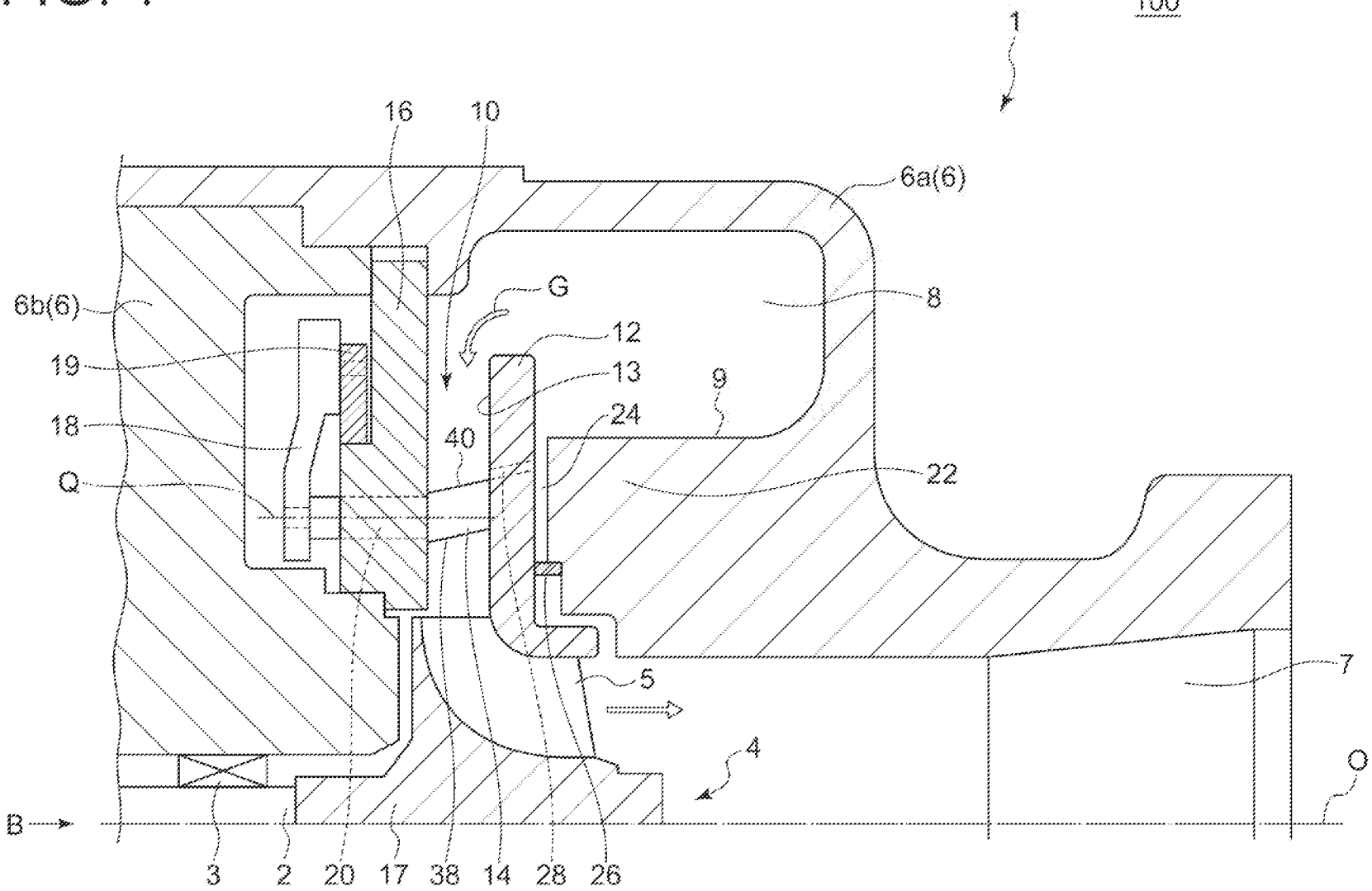
FIG. 1 is a schematic cross-sectional view of a turbocharger according to an embodiment, taken along the rotational axis.

FIG. 1 is a schematic cross-sectional view of a turbocharger according to an embodiment, taken along the rotational axis O. As shown in FIG. 1, the turbocharger 100 includes a turbine 1 having a turbine impeller 4 configured to be rotationally driven by exhaust gas from an engine (not shown) and a compressor (not shown) connected to the turbine 1 via a rotational shaft 2 rotatably supported by a bearing 3. The compressor is configured to be coaxially driven by rotation of the turbine impeller 4 to compress intake air flowing into the engine.

The turbine 1 shown in FIG. 1 is a radial turbine in which exhaust gas as a working fluid enters in the radial direction. However, the operation system of the turbine 1 is not limited thereto. For example, in some embodiments, the turbine 1 may be a mixed flow turbine in which an entering working fluid has velocity components in the radial direction and the axial direction.

The turbine impeller 4 is housed in a housing 6 disposed so as to enclose the turbine impeller 4, and includes a hub 17 connected to the rotational shaft 2 and a plurality of blades 5 arranged in the circumferential direction on an outer circumferential surface of the hub 17.

The housing 6 includes a scroll passage 8 positioned on an outer circumferential side of the turbine impeller 4 and an inner circumferential wall part 22 defining an inner circumferential boundary 9 of the scroll passage 8. As shown in FIG. 1, the housing 6 may include a turbine housing **6*a* which is a portion housing the turbine impeller 4 and a bearing housing 6*b* which is a portion housing the bearing 3**.

On the outer circumferential side of the turbine impeller 4, an intermediate flow passage 10 through which exhaust gas flows from the scroll passage 8 into the turbine impeller 4 is formed. In other words, the intermediate flow passage 10 is positioned, in the exhaust gas flow direction, downstream of the scroll passage 8 and upstream of the turbine impeller 4.

Figure 2:
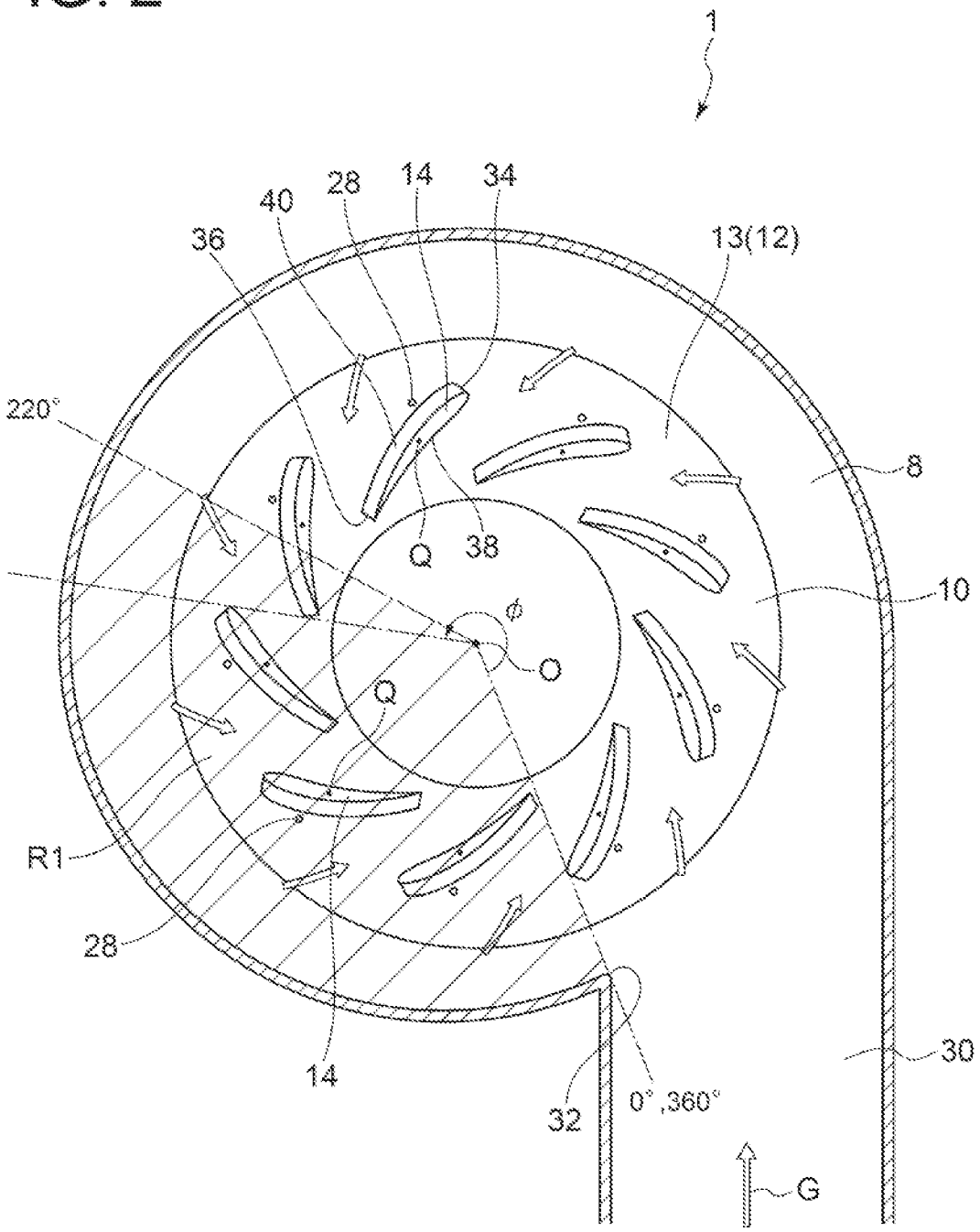
FIG. 2 is a schematic cross-sectional view of the turbine shown in FIG. 1, perpendicular to the rotational axis.

FIG. 2 is a schematic cross-sectional view of the turbine 1 shown in FIG. 1, perpendicular to the rotational axis O. FIG. 2 is a diagram of the turbine 1 viewed in the direction of the arrow B shown in FIG. 1, and shows a cross-section of a portion including the scroll passage 8 of the housing 6, a nozzle plate 12, and nozzle vanes 14, but some components such as the turbine impeller 4 are not depicted for simplification of description.

As shown in FIGS. 1 and 2, inside the intermediate flow passage 10, a plurality of nozzle vanes 14 for adjusting exhaust gas flow entering the turbine impeller 4 is arranged in the circumferential direction.

The intermediate flow passage 10 is formed between a nozzle mount 16 to which the nozzle vanes 14 are mounted and a nozzle plate 12 (plate in the present invention) disposed on the opposite side across the nozzle vanes 14 in the axial direction of the turbine 1 (hereinafter also simply referred to as "axial direction"). The nozzle mount 16 is fixed to the bearing housing 6*b* with a bolt (not shown) or the like. Between the nozzle mount 16 and the nozzle plate 12, for example, a pillar material (not shown) extending in the axial direction is disposed. The pillar material supports the nozzle plate 12 spaced from the nozzle mount 16 in the axial direction. Between the nozzle plate 12 and the inner circumferential wall part 22 of the housing 6, an annular seal member 26 is disposed so as to suppress leakage of exhaust gas from the scroll passage 8 to a space downstream of the turbine impeller 4 (i.e., leakage of exhaust gas not via the turbine impeller 4).

The nozzle vane 14 includes an airfoil portion having a leading edge 34 and a trailing edge 36 (see FIG. 2) extending between the nozzle mount 16 and the nozzle plate 12. Additionally, the nozzle vane 14 includes a pressure surface 38 and a suction surface 40 extending from the leading edge 34 to the trailing edge 36. In a cross-section (see FIG. 1) perpendicular to the axial direction, the suction surface 40 is positioned radially outside the pressure surface 38.

Each of the plurality of nozzle vanes 14 is connected to one end of a lever plate 18 via a nozzle shaft 20. Further, the other end of the lever plate 18 is connected to a disc-shaped drive ring 19.

The drive ring 19 is driven by an actuator (not shown) so as to be rotatable around the rotational axis O. When the drive ring 19 rotates, each lever plate 18 rotates. Accordingly, the nozzle shaft 20 rotates around a rotation axis Q along the axial direction, so that the opening degree (blade angle) of the nozzle vane 14 is changed via the nozzle shaft 20.

In the turbine 1 of the turbocharger 100 having this configuration, exhaust gas entering from an inlet flow passage 30 (see FIG. 2) into the scroll passage 8 (see arrow G of FIGS. 1 and 2) flows into the intermediate flow passage 10 between the nozzle mount 16 and the nozzle plate 12, in which the nozzle vanes 14 control the flow direction of the gas so as to flow into a central portion of the housing 6. Then, after acting on the turbine impeller 4, the exhaust gas is discharged to the outside from an exhaust outlet 7.

Further, the exhaust gas passage area inside the housing 6 may be changed by appropriately changing the opening degree of the nozzle vanes 14 in accordance with exhaust gas amount entering the turbine 1 to adjust the flow velocity of exhaust gas into the turbine impeller 4. Thus, it is possible to obtain excellent turbine efficiency.

Hereinafter, characteristics of the turbine 1 according to some embodiments will be described.

As shown in FIGS. 1 and 2, the nozzle plate 12 (plate) is disposed on a side of the intermediate flow passage 10 with respect to the inner circumferential wall part 22 of the housing 6 so as to face the intermediate flow passage 10 such that a gap 24 is formed between the nozzle plate 12 and the inner circumferential wall part 22 in the axial direction. The nozzle plate 12 has at least one through hole 28 through which the intermediate flow passage 10 and the gap 24 are communicated with each other. This through hole 28 opens to a surface 13 of the nozzle plate 12 facing the intermediate flow passage 10, at a position on the radially outer side with respect to the suction surface 40 of at least one of the plurality of nozzle vanes 14 (hereinafter, also referred to as "nozzle vane 14 corresponding to through hole 28").

In the present embodiment, as shown in FIG. 2, one through hole 28 is provided for each of the plurality of nozzle vane 14 (i.e., the nozzle plate 12 has the same number of through holes 28 as the number of nozzle vanes 14). However, in other embodiments, one through hole 28 may be provided for some of the plurality of nozzle vanes 14 (i.e., the number of through holes 28 may be smaller than the number of nozzle vanes 14).

Figure 6:
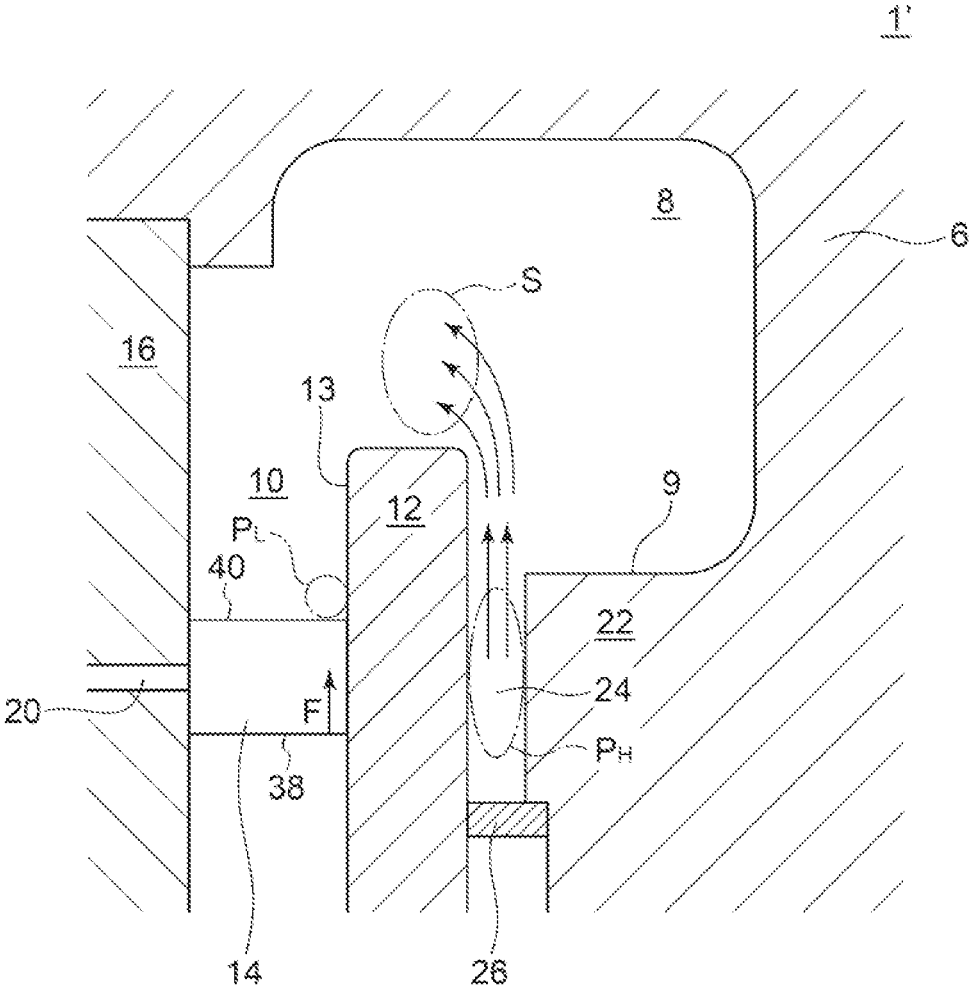
FIG. 6 is a cross-sectional view of a typical turbine, taken along the axial direction.

FIG. 6 is a cross-sectional view of a typical turbine 1', taken along the axial direction. The turbine 1' shown in FIG. 6 has basically the same configuration as the turbine 1 shown in FIG. 1, but is different from the turbine 1 shown in FIG. 1 in that the nozzle plate 12 has no through hole 28.

During operation of the turbine 1, 1', the gap 24 between the inner circumferential wall part 22 of the housing 6 and the nozzle plate 12 forming the intermediate flow passage 10 may have relatively high pressure (region $P_H$ in FIG. 6), while a relatively low pressure region $P_L$ may be formed in the vicinity of the suction surface 40 of the nozzle vane 14 disposed in the intermediate flow passage 10 (see FIG. 6). In this case, due to the pressure differential between the gap 24 and the vicinity of the suction surface 40 of the nozzle vane 14, a flow S (see FIG. 6) with turbulence from the gap 24 via the outer circumferential edge of the nozzle plate 12 to the suction surface of the nozzle vane may be generated. Such flow with turbulence may cause pressure loss.

In this regard, with the turbine 1 according to the above embodiment, since the plate has the through hole 28 through which the intermediate flow passage 10 and the gap 24 are communicated with each other and which opens on a side of the intermediate flow passage 10 at a position on the radially outer side with respect to the suction surface 40 of the nozzle vane 14, the pressures in the gap 24 and in the vicinity of the suction surface 40 of the nozzle vane 14 inside the intermediate flow passage 10 are equalized through the through hole 28. Thus, since the flow (see FIG. 6) with turbulence from the gap 24 via the outer circumferential edge of the nozzle plate 12 to the suction surface 40 of the nozzle vane 14 due to the pressure differential between the gap 24 and the vicinity of the suction surface 40 of the nozzle vane 14 is suppressed, it is possible to reduce pressure loss in the turbine 1.

Further, when there is the pressure differential between the gap 24 and the vicinity of the suction surface 40 of the nozzle vane 14, as shown in FIG. 6, a force F due to this pressure differential acts on the nozzle vane 14 and causes the nozzle vane 14 to tilt with respect to the nozzle plate 12, which may cause friction between the nozzle vane 14 and the nozzle plate 12.

In this regard, with the turbine 1 according to the above embodiment, since the pressures in the intermediate flow passage 10 and the gap 24 are equalized through the through hole 28, it is possible to prevent the nozzle vane 14 from tilting due to the pressure differential, and it is possible to suppress friction between the nozzle vane 14 and the nozzle plate 12.

Figure 3:
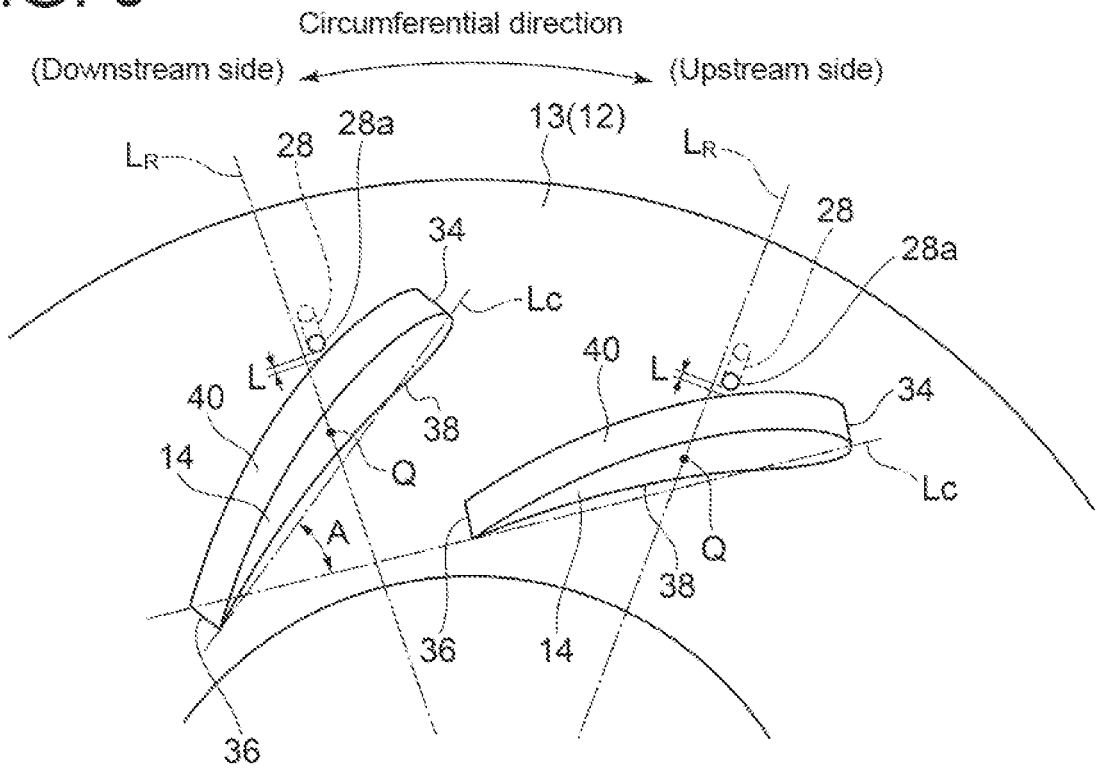
FIG. 3 is a partial enlarged view of FIG. 2 and shows a pair of nozzle vanes adjacent to each other in the circumferential direction and the vicinity thereof.
Figure 4:
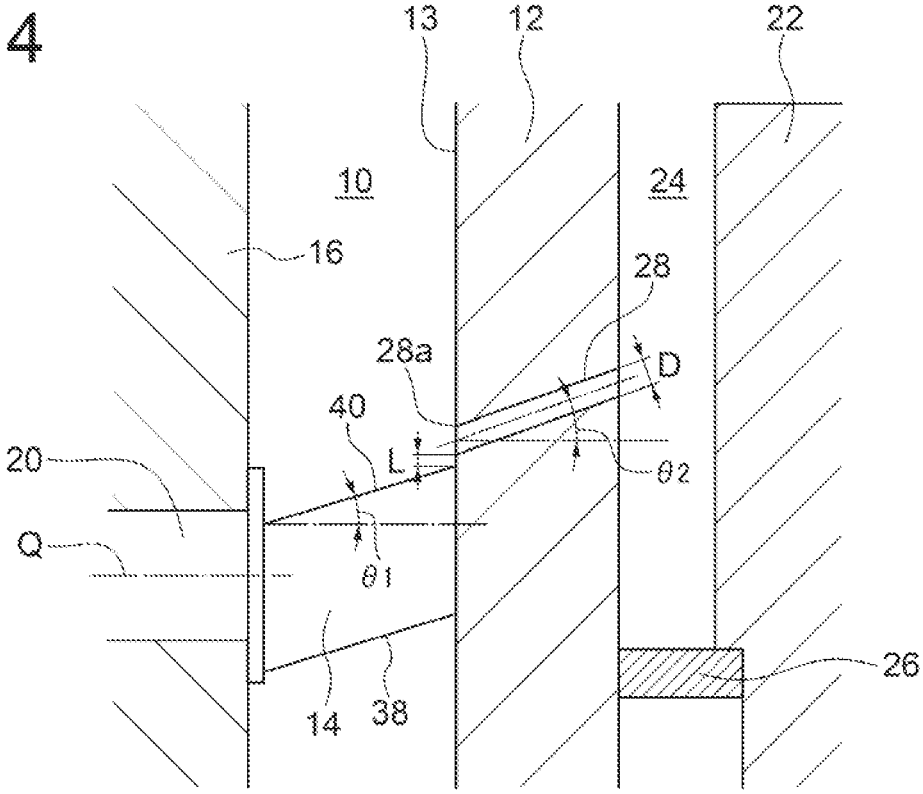
FIG. 4 is a cross-sectional view of the turbine shown in FIG. 3, taken along the axial direction.
Figure 5:
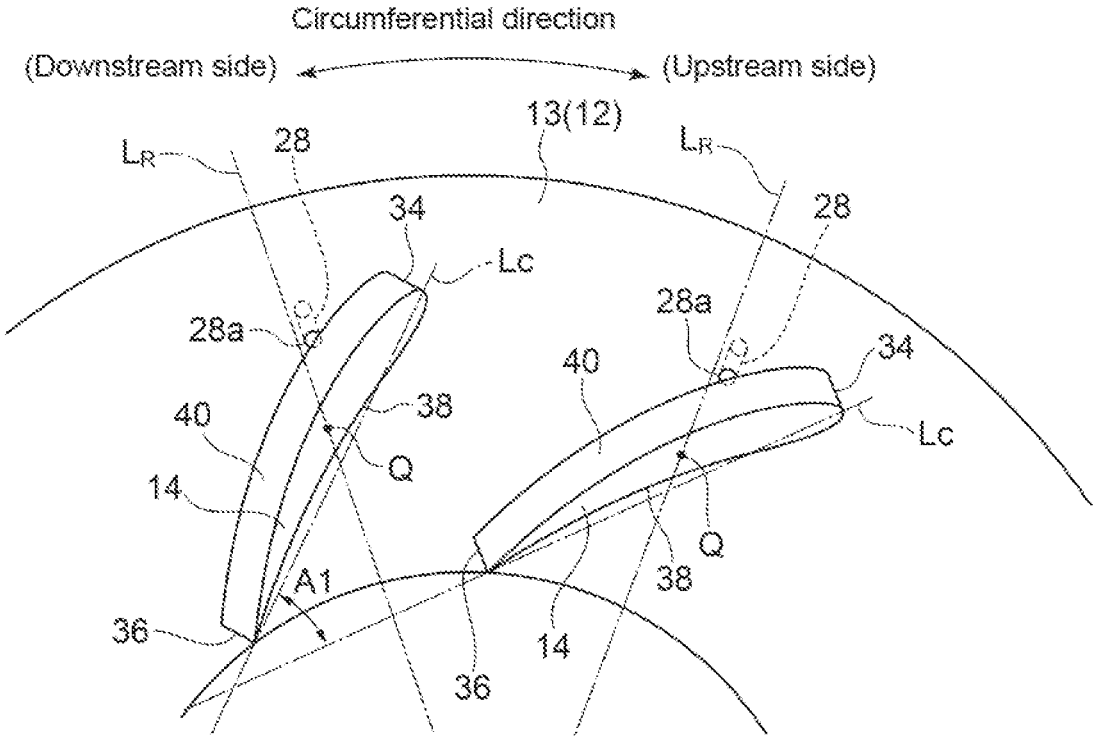
FIG. 5 is a diagram corresponding to FIG. 3 when the opening degree of the nozzle vanes is maximum.

FIG. 3 is a partial enlarged view of FIG. 2 and shows a pair of nozzle vanes 14 adjacent to each other in the circumferential direction and the vicinity thereof. FIG. 4 is a cross-sectional view of the turbine 1 shown in FIG. 3, taken along the axial direction, i.e., a partial enlarged view of FIG. 1. FIG. 5 is a diagram showing the pair of nozzle vanes 14 and the vicinity thereof corresponding to FIG. 3 when the opening degree of the nozzle vanes 14 is maximum.

Here, the opening degree of the nozzle vanes 14 corresponds to an angle A between chord directions (directions connecting leading edge 34 and trailing edge 36) of a pair of nozzle vanes 14 which are adjacent to each other in the circumferential direction. The larger the angle A, the greater the opening degree of the nozzle vanes 14. FIG. 5 shows a pair of nozzle vanes 14 adjacent in the circumferential direction when the opening degree of the nozzle vanes 14 is maximum, where A1 is the angle A between circumferential directions of the pair of nozzle vanes. The straight lines Lc in FIGS. 3 and 5 are lines of chordwise directions of the nozzle vanes 14.

In some embodiments, for example as shown in FIG. 4, the through hole 28 opens to the surface 13 of the nozzle plate 12 facing the intermediate flow passage 10 at a position on the radially outer side with respect to the suction surface 40 of the nozzle vane 14 when the opening degree of each nozzle vane 14 is within at least a part of a large opening degree region in which A is not less than $0.5\times A_1$. In other words, for example as shown in FIGS. 3, 4, and 5, at least a part of an opening 28*a* of the through hole 28 on the surface 13 is positioned on the radially outer side of the suction surface 40 of the nozzle vane 14.

According to findings of the present inventors, the pressure differential (see FIG. 6) between the gap 24 and the vicinity of the suction surface 40 of the nozzle vane 14 which may occur during operation of the turbine increases as the opening degree of the nozzle vane 14 relatively increases, which leads to significant pressure loss due to the pressure differential.

In this regard, in the above embodiment, since the through hole 28 opens to the surface 13 of the nozzle plate 12 at a position on the radially outer side with respect to the suction surface 40 of the nozzle vane 14 when the opening degree of each nozzle vane 14 is within at least a part of a large opening degree region in which A is not less than $0.5\times A_1$, it is possible to, in the large opening degree region of the nozzle vane 14, reliably equalize the pressures in the gap 24 and in the vicinity of the suction surface 40 of the nozzle vane 14 inside the intermediate flow passage 10 through the through hole 28. Thus, the flow S (see FIG. 6) with turbulence from the gap 24 via the outer circumferential edge of the nozzle plate 12 to the suction surface 40 of the nozzle vane 14 due to the pressure differential is suppressed, so that it is possible to more effectively reduce pressure loss in the turbine 1.

In some embodiments, for example as shown in FIGS. 3 and 5, the through hole 28 opens to the surface 13 of the nozzle plate 12 at a position, in the circumferential direction, on the upstream side in the exhaust gas flow direction with respect to the rotation axis Q of the nozzle vane 14 corresponding to the through hole 28. In other words, the opening 28*a* of the through hole 28 on the surface 13 is positioned, in the circumferential direction, on the upstream side in the exhaust gas flow direction with respect to a line $L_R$ (see FIGS. 3 and 5) in the radial direction passing the rotation axis Q of the nozzle vane 14.

In this case, since the through hole 28 opens to the surface 13 of the nozzle plate 12 facing the intermediate flow passage 10, at a position, in the circumferential direction, on the upstream side in the exhaust gas flow direction with respect to the rotation axis Q of the nozzle vane 14, the opening 28*a* of the through hole 28 on the surface 13 easily comes close to the suction surface 40 as the opening degree of the nozzle vane 14 increases. Thus, the flow (see FIG. 6) with turbulence from the gap 24 via the outer circumferential edge of the nozzle plate 12 to the suction surface 40 of the nozzle vane 14 due to the pressure differential is suppressed, so that it is possible to more effectively reduce pressure loss in the turbine 1.

In some embodiments, when the opening degree of each of the plurality of nozzle vanes 14 is such that A is $0.75\times A_1$, a distance L (see FIGS. 3 and 4) in the radial direction between the through hole 28 and the suction surface 40 of the nozzle vane 14 corresponding to the through hole 28 is not greater than a diameter D (see FIG. 3) of the through hole 28.

In this case, since when the opening degree of the nozzle vane 14 is such that A is $0.75\times A_1$, the distance L in the radial direction between the through hole 28 and the suction surface 40 of the nozzle vane 14 is not greater than the diameter D of the through hole 28, the through hole 28 and the suction surface 40 of the nozzle vane 14 are relatively close to each other within a large opening degree region (e.g., opening degree region in which A is not less than $0.5\times A_1$) of the nozzle vane 14. Thus, in the large opening degree region of the nozzle vane 14, a region of the intermediate flow passage 10 in the vicinity of the suction surface 40 of the nozzle vane 14 communicates with the gap 24 through the through hole 28, so that the pressures in the gap 24 and in the vicinity of the suction surface 40 of the nozzle vane 14 inside the intermediate flow passage 10 are smoothly equalized through the through hole 28. Thus, the flow S (see FIG. 6) with turbulence from the gap 24 via the outer circumferential edge of the nozzle plate 12 to the suction surface 40 of the nozzle vane 14 due to the pressure differential between the gap 24 and the vicinity of the suction surface 40 of the nozzle vane 14 is more effectively suppressed.

In some embodiments, when the opening degree of each of the plurality of nozzle vanes 14 is maximum (see FIG. 5), at least a part of the through hole 28 is positioned on the radially outer side with respect to the nozzle vane 14 corresponding to the through hole 28, at the surface 13 of the nozzle plate 12. In other words, the opening 28*a* of the through hole 28 on the surface 13 is at least partially positioned on the radially outer side of the suction surface 40 of the nozzle vane 14.

In this case, when the opening degree of the nozzle vane 14 is maximum (i.e., when the angle A is $A_1$), at least a part of the through hole 28 is positioned on the radially outer side with respect to the nozzle vane 14, at the surface 13 of the nozzle plate 12 facing the intermediate flow passage 10. In other words, even when the opening degree of the nozzle vane 14 is maximum and the suction surface 40 of the nozzle vane 14 is closest to the through hole 28, the opening 28*a* of the through hole 28 on the surface 13 of the nozzle plate 12 is not closed by the nozzle vane 14.

Thus, even when the opening degree of the nozzle vane 14 is maximum, a region of the intermediate flow passage 10 in the vicinity of the suction surface 40 of the nozzle vane 14 reliably communicates with the gap 24 through the through hole 28. Thus, the pressures in the gap 24 and the vicinity of the suction surface 40 of the nozzle vane 14 inside the intermediate flow passage 10 are equalized through the through hole 28, and the flow S (see FIG. 6) with turbulence from the gap 24 via the outer circumferential edge of the nozzle plate 12 to the suction surface 40 of the nozzle vane 14 due to the pressure differential between the gap 24 and the vicinity of the suction surface 40 of the nozzle vane 14 is more effectively suppressed.

In some embodiments, for example as shown in FIG. 4, in a cross-section including the axial direction, the through hole 28 extends along the extending direction of the suction surface 40 of the nozzle vane 14 corresponding to the through hole 28.

Alternatively, in some embodiments, for example as shown in FIG. 4, in a cross-section including the axial direction, the suction surface 40 of the nozzle vane 14 extends obliquely with respect to the axial direction, and the through hole 28 extends along the oblique direction of the suction surface 40 with respect to the axial direction.

In the exemplary embodiment shown in FIG. 4, in a cross-section including the axial direction, the suction surface 40 of the nozzle vane 14 is oblique toward the radially inner side from the nozzle plate 12 (shroud side) to the nozzle mount 16 (hub side).

In this case, since the through hole 28 extends in the extending direction of the suction surface 40 of the nozzle vane 14, it is possible to reduce turbulence of flow from the through hole 28 to the intermediate flow passage 10. Consequently, it is possible to more effectively reduce pressure loss in the turbine.

In some embodiments, $|\theta 1-\theta 2|\leq 20°$ may be satisfied, where θ1 is an angle (see FIG. 4) of the suction surface 40 of the nozzle vane 14 with respect to the axial direction, and θ2 is an angle (see FIG. 4) of the through hole 28 with respect to the axial direction in a cross-section including the axial direction.

In this case, since the difference between θ1 and θ2 is small, the through hole 28 extends in the extending direction of the suction surface 40 of the nozzle vane 14. Thus, it is possible to reduce turbulence of flow from the through hole 28 to the intermediate flow passage 10, and it is possible to more effectively reduce pressure loss in the turbine.

In some embodiments, in a cross-section perpendicular to the axial direction, when the rotational axis O of the turbine 1 is taken as a center, an angle at a position of a scroll tongue 32 is defined as 0 degree (see FIG. 2), and the exhaust gas flow direction in the circumferential direction is taken as a positive angular direction, at least one through hole 28 is positioned within a range of at least 220 degrees and at most 360 degrees. The range R1 shown by the hatched area in FIG. 2 represents this angular range (at least 220 degrees and at most 360 degrees), and the angle Φ represents an example of angle within this range.

The scroll tongue 32 is a connection portion between the start and end of a scroll part of the housing 6 forming the scroll passage 8.

According to findings of the present inventors, in the vicinity of the outlet of the scroll passage 8 (in the vicinity of the scroll end), the pressure differential between the gap 24 and the vicinity of the suction surface 40 of the nozzle vane 14 tends to particularly increase, so that the flow S (see FIG. 6) with turbulence which may cause pressure loss in the turbine 1 is likely to occur.

In this regard, according to the above embodiment, since at least one through hole 28 is provided within the range R1 in which the above-described angle in the circumferential direction is at least 220 degrees and at most 360 degrees (i.e., in the vicinity of the outlet of the scroll passage 8), in this circumferential region, the pressures in the gap 24 and the vicinity of the suction surface 40 of the nozzle vane 14 inside the intermediate flow passage 10 are equalized through the through hole 28. Thus, the flow with turbulence from the gap 24 via the outer circumferential edge of the nozzle plate 12 to the suction surface 40 of the nozzle vane 14 due to the pressure differential between the gap 24 and the vicinity of the suction surface 40 of the nozzle vane 14 is effectively suppressed, so that it is possible to effectively reduce pressure loss in the turbine 1.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

REFERENCE SIGNS LIST

1 Turbine
2 Rotational shaft
3 Bearing
4 Turbine impeller
5 Blade
6 Housing
6*a* Turbine housing
6*b* Bearing housing
7 Exhaust outlet
8 Scroll passage
9 Inner circumferential boundary
10 Intermediate flow passage
12 Nozzle plate
13 Surface
14 Nozzle vane
16 Nozzle mount
17 Hub
18 Lever plate
19 Drive ring
20 Nozzle shaft
22 Inner circumferential wall part
24 Gap
26 Seal member
28 Through hole
28*a* Opening
30 Inlet flow passage
32 Scroll tongue
34 Leading edge
36 Trailing edge
38 Pressure surface
40 Suction surface
100 Turbocharger

The invention claimed is:

1. A turbine comprising:

a turbine impeller;

a housing disposed so as to enclose the turbine impeller, the housing including a scroll passage positioned on an outer circumferential side of the turbine impeller and an inner circumferential wall part defining an inner circumferential boundary of the scroll passage;

a plurality of nozzle vanes disposed inside an intermediate flow passage which is positioned, in an exhaust gas flow direction, on a downstream side of the scroll passage and on an upstream side of the turbine impeller; and a plate disposed on a side of the intermediate flow passage with respect to the inner circumferential wall part so as to face the intermediate flow passage such that a gap is formed between the plate and the inner circumferential wall part in an axial direction, wherein the plate has at least one through hole through which the intermediate flow passage and the gap are communicated with each other, wherein the at least one through hole opens to a surface of the plate facing the intermediate flow passage, at a position on a radially outer side with respect to a suction surface of at least one of the plurality of nozzle vanes, wherein the plurality of nozzle vanes is disposed so as to be rotatable around a rotation axis extending along the axial direction, wherein the at least one through hole opens to the surface of the plate at a position, in a circumferential direction, on an upstream side in the exhaust gas flow direction with respect to the rotation axis of the at least one nozzle vane, wherein the plurality of nozzle vanes is arranged in the circumferential direction inside the intermediate flow passage so as to be rotatable around the rotation axis extending along the axial direction, and wherein when an opening degree of each of the plurality of nozzle vanes is such that A is $0.75 \times A_1$, a distance L in a radial direction between the at least one through hole and the suction surface of the at least one nozzle vane is not greater than a diameter D of the at least one through hole, where A is an angle between chord directions of a pair of nozzle vanes which are adjacent to each other in the circumferential direction, among the plurality of nozzle vanes, and $A_1$ is the angle when the opening degree of the plurality of nozzle vanes is maximum.

2. The turbine according to claim 1, wherein the plurality of nozzle vanes is arranged in the circumferential direction inside the intermediate flow passage so as to be rotatable around the rotation axis extending along the axial direction, and wherein the at least one through hole opens to the surface at a position on a radially outer side with respect to the suction surface when an opening degree of each of the plurality of nozzle vanes is within at least a part of a large opening degree region in which A is not less than $0.5 \times A_1$, where A is an angle between chord directions of a pair of nozzle vanes which are adjacent to each other in the circumferential direction, among the plurality of nozzle vanes, and $A_1$ is the angle when the opening degree of the plurality of nozzle vanes is maximum.

3. The turbine according to claim 1, wherein the plurality of nozzle vanes is arranged in the circumferential direction inside the intermediate flow passage so as to be rotatable around the rotation axis extending along the axial direction, and wherein when an opening degree of each of the plurality of nozzle vanes is maximum, at least a part of the at least one through hole is positioned on a radially outer side with respect to the at least one nozzle vane, at the surface of the plate.

4. The turbine according to claim 1, wherein in a cross-section of the plate perpendicular to the axial direction, when a rotational axis of the turbine is taken as a center, an angle at a position of a tongue of the scroll passage is defined as 0 degree, and the exhaust gas flow direction in the circumferential direction is taken as a positive angular direction, the at least one through hole is positioned within a range of at least 220 degrees and at most 360 degrees.

5. The turbine according to claim 1, wherein in a cross-section including the axial direction, the at least one through hole extends along an extending direction of the suction surface of the at least one nozzle vane.

6. The turbine according to claim 5, wherein in a cross-section including the axial direction, the suction surface extends obliquely with respect to the axial direction, and the at least one through hole extends along an oblique direction of the suction surface with respect to the axial direction.

7. A turbocharger comprising:

a turbine according to claim 1; and a compressor configured to be driven by the turbine.

* * * * *